US007752793B2

(12) United States Patent
Labedz et al.

(10) Patent No.: US 7,752,793 B2
(45) Date of Patent: Jul. 13, 2010

(54) NON-RECTANGULAR FRAME MENU BOARD AND ILLUMINATED DISPLAY DEVICE

(75) Inventors: Lawrence Labedz, Naperville, IL (US); William Carter, Dyer, IN (US); Mitchell Cooper, Plainfield, IL (US)

(73) Assignee: Florida Plastics International, Inc., Evergreen Park, IL (US)

( * ) Notice: Subject to any disclaimer, the term of this patent is extended or adjusted under 35 U.S.C. 154(b) by 858 days.

(21) Appl. No.: 11/096,893

(22) Filed: Apr. 1, 2005

(65) Prior Publication Data

US 2006/0218830 A1 Oct. 5, 2006

(51) Int. Cl.
*G09F 13/04* (2006.01)

(52) U.S. Cl. ..... 40/618; 40/575

(58) Field of Classification Search ..... 40/571, 40/610, 570

See application file for complete search history.

(56) References Cited

U.S. PATENT DOCUMENTS

| | | | | | |
|---|---|---|---|---|---|
| 2,852,145 | A | * | 9/1958 | Scholz | 211/204 |
| 3,390,259 | A | * | 6/1968 | Angier | 40/549 |
| 3,680,712 | A | * | 8/1972 | Jurasek | 211/59.2 |
| 4,299,042 | A | * | 11/1981 | Rasmussen | 40/571 |
| 4,367,604 | A | | 1/1983 | Porter, II | |
| 4,430,819 | A | * | 2/1984 | Chandler | 40/564 |
| 4,461,107 | A | | 7/1984 | Grate | |
| 4,521,984 | A | | 6/1985 | Murray | |
| 4,980,998 | A | * | 1/1991 | Amstutz et al. | 52/28 |
| 5,477,789 | A | * | 12/1995 | Von Gunten | 108/108 |
| 5,636,463 | A | | 6/1997 | Sharon | |
| 5,682,694 | A | | 11/1997 | Hillstrom | |
| 5,901,486 | A | | 5/1999 | Sharon | |
| 5,983,543 | A | | 11/1999 | Hillstrom | |
| 6,048,075 | A | * | 4/2000 | Lai | 362/240 |
| 6,125,565 | A | | 10/2000 | Hillstrom | |
| 6,178,678 | B1 | | 1/2001 | Stoddard | |
| 6,298,589 | B1 | | 10/2001 | Hillstrom | |
| 6,631,576 | B2 | | 10/2003 | Hillstrom | |
| 6,637,608 | B1 | * | 10/2003 | Schneider | 211/90.02 |
| 6,688,025 | B1 | | 2/2004 | Cullinan | |
| 5,682,694 | C1 | | 8/2004 | Hillstrom | |
| 5,983,543 | C1 | | 8/2004 | Hillstrom | |
| 2001/0032404 | A1 | | 10/2001 | Hillstrom | |
| 2004/0045200 | A1 | | 3/2004 | Hillstrom | |

FOREIGN PATENT DOCUMENTS

| | | |
|---|---|---|
| FR | 2404882 | 4/1979 |

* cited by examiner

*Primary Examiner*—Cassandra Davis
(74) *Attorney, Agent, or Firm*—Ryndak & Suri LLP

(57) ABSTRACT

An illuminated display device having a menu board and a light source is provided. The menu board has translucent display members and a frame with substantially parallel frame members and at least one cross member connected to the frame members. The cross members are located between the display members and the lighting sources. The cross members may be offset from the display members so that the cross members do not cast a shadow upon the display members. The cross members may be disposed at various angles to the frame members and to other cross members.

29 Claims, 3 Drawing Sheets

NON-RECTANGULAR FRAME MENU BOARD AND ILLUMINATED DISPLAY DEVICE

FIELD OF THE INVENTION

This invention relates to a non-rectangular frame menu board and an illuminated display device incorporating one or more of the menu boards. Such display devices are particularly suitable for indoor or outdoor use, such as at restaurants, for example.

BACKGROUND OF THE INVENTION

Various display boards are known in the art, such as illuminated menu display boards, which are commonly utilized at fast-food restaurants, for example, to display food items, associated pricing, advertised specials, and other information. These menu display boards are commonly used in outdoor locations at "drive-through" windows and indoors behind and above typical restaurant counters. Changes to the displayed information frequently need to be made due to customer demand, menu changes, pricing changes, or for other reasons. Thus, there is a need for a menu display board wherein the displayed information is easily changed and yet is of simple construction.

Display boards are made in just a few plants and distributed nationally. The display boards may be partially assembled at the plant or at a distributor or installer's location. The displays must withstand repeated changing of the displayed information. Thus, there is a need for a lightweight yet durable menu board.

However, lightweight frames tend to be flexible. This reduces the desirability of complete off-site assembly of menu boards because parts of the menu board may loosen after transportation. Thus, there is a need for a rigid frame.

SUMMARY OF THE INVENTION

In accordance with one aspect of the present invention, an illuminated display device is provided. The illuminated display device has at least one translucent or partially translucent display member or menu strip, a frame, and a light source. The translucent display member is generally used to describe and/or picture an item from a restaurant menu. The light source is located behind the display members to backlight the display member. The frame has two substantially parallel frame members and at least one cross member. Preferably the frame members are substantially vertical. The frame members are connected to the cross member, and the cross member is offset from and behind the display members. The display members are removably mounted to the frame so that they can be easily changed.

In accordance with another aspect of the present invention, a menu board is provided. The menu board has a frame and a series of retention members. The frame has two substantially parallel frame members and at least one cross member. Preferably the frame members are substantially vertical. The frame members are connected to the cross member. The cross member is disposed at an angle less than 90 degrees to the frame members. The retention members are formed in or positioned on the frame members. The retention members are meant for holding display holders for holding the translucent display members.

In accordance with another aspect of the present invention, a menu board is provided. The menu board has a frame and a series of retention members. The frame has two substantially parallel frame members and two cross members which intersect. The retention members are formed in or positioned on the frame members. The retention members are meant for holding display holders for holding translucent display members.

The cross members reinforce the frame. The offset between the frame members and the cross members allows cross members to be connected to the frame members in various positions without casting shadows onto the translucent display members. Thus the frame members can be reinforced near their middle and near their ends. This allows the frame to be lightweight, durable, and rigid.

Other advantages and features of the invention will become apparent from the following description and from reference to the drawings.

DETAILED DESCRIPTION

Figure 1:
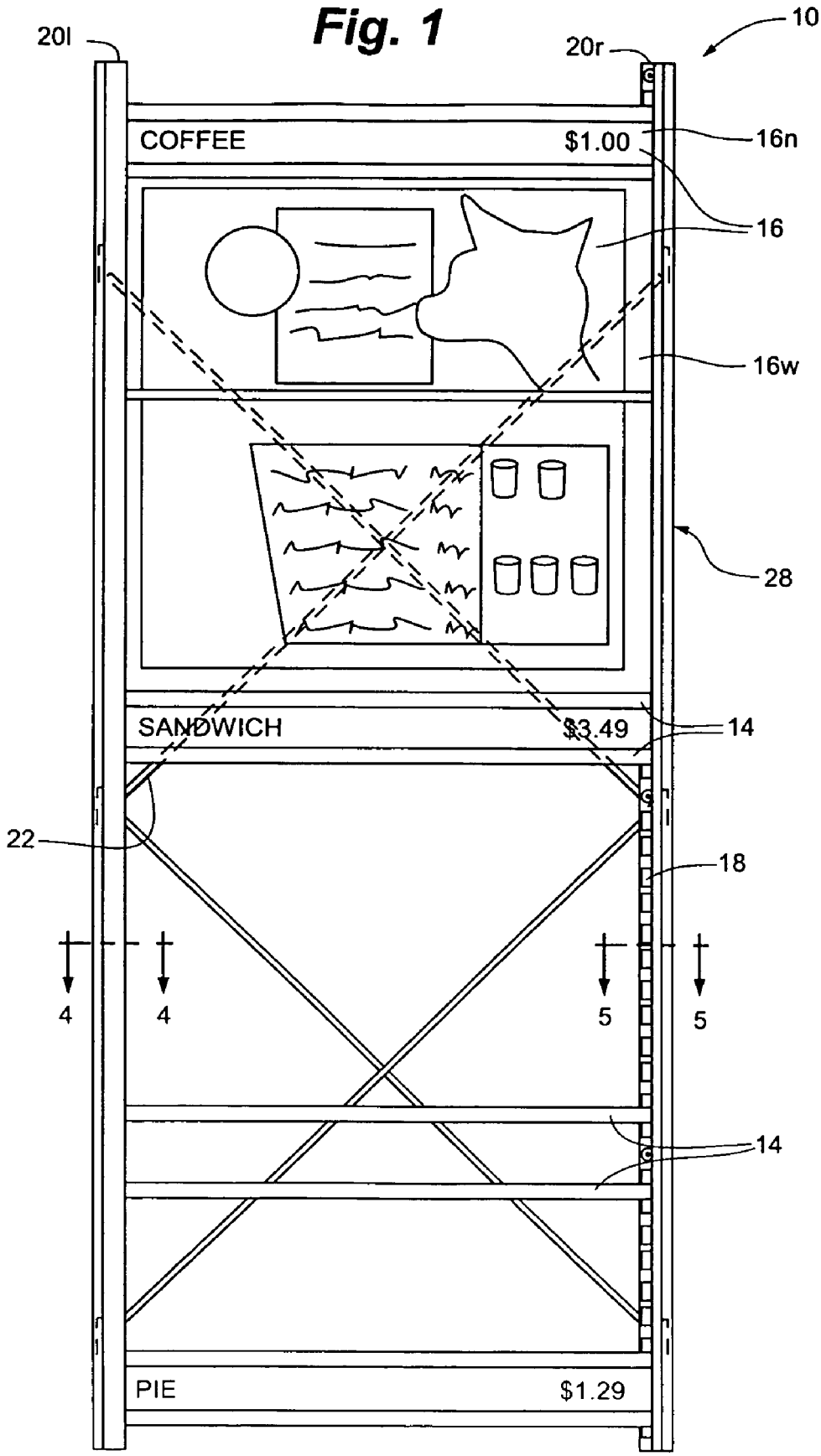
FIG. 1 is a front elevation view illustrating a menu board in accordance with the present invention.

While this invention is susceptible of embodiment in many different forms, there is shown in the drawings and described in detail herein specific embodiments with the understanding that the present disclosure is to be considered as exemplifications of the principles of the invention and is not intended to limit the invention to the embodiments illustrated.

Referring to the figures generally, and in particular to FIG. 1, a menu board 10 is shown. The menu board has a frame 28. Frame 28 has two substantially parallel frame members **20*l* and 20*r*. Preferably, frame members 20*l* and 20*r* are substantially vertical. Frame members 20*l* and 20*r* are fixed relative to each other by one or more diagonal braces or cross members 22. There are preferably two, more preferably three, and most preferably four or more cross members 22** to provide rigidity.

Cross members 22 are preferably arranged in pairs that intersect or form an "X." Preferably one cross member 22 will cross another one at an angle in the range of from about 30° to about 150°, more preferably in the range of from about 45° to about 135°, still more preferably in the range of from about 60° to about 120°, and most preferably about 90°. It should be understood that the cross members and frame members do not have to contact each other for there to be an angle or an intersection for purposes of this invention. Where two cross members do not contact each other, the cross members are considered to intersect if the orthogonal projections of the cross members onto a plane containing the two parallel frame members intersect. Similarly, where two cross members do not contact each other, the angle between the cross members can be measured by measuring the angle between the orthogonal projections of the cross members onto a plane containing the two parallel frame members.

Cross members may also share a common portion. For example, two cross members may both be at a 45° angle to the frame members at a first connection location, may converge together at a 90° angle at a point between the frame members, share a common vertical portion, diverge at a 90° angle, and make a 45° angle to the frame members at a second connection location. Cross members 22 can be arranged in other patterns. For example, they can be parallel to each other (not shown).

Cross members 22 can connect to frame members, 20*l* and 20*r*, at different angles. Preferably the angle is greater than 10 degrees, more preferably greater than 20 degrees, yet more preferably in the range of from about 30° to about 60° or in the range of from about 75° to about 105° , still more preferably in the range of from about 40° to about 50° or in the range of from about 85° to about 95°, and most preferably about 45° or about 90°.

Figure 2:
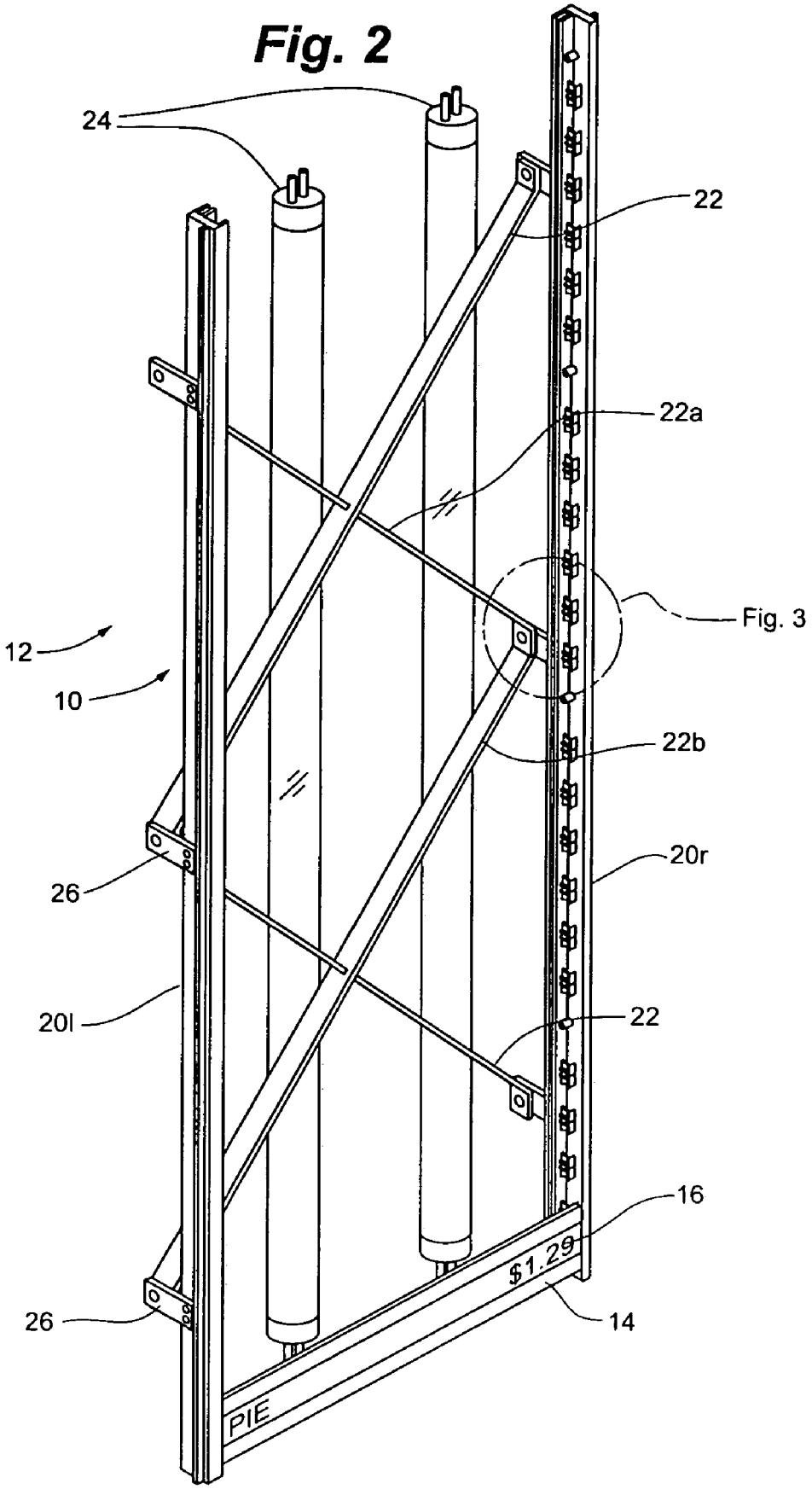
FIG. 2 is a perspective view of the illuminated display device including the menu board of FIG. 1 with all but two of the display holders and one of the display members removed.

Cross members 22 can connect to frame members, 20*l* and 20*r*, anywhere along the length of the frame members. Preferably cross members 22 connect to the frame members, 20*l* and 20*r*, both near the middle of a frame member and near the end of the other frame member as seen in FIGS. 1 and 2. Alternatively one cross member 22 is connected near the middle of both frame members 20*l* and 20*r* and other cross members 22 are connected near the ends of frame members 20*l* and 20*r*. This preferred arrangement provides a frame that is lightweight, strong, and rigid.

Figure 3:
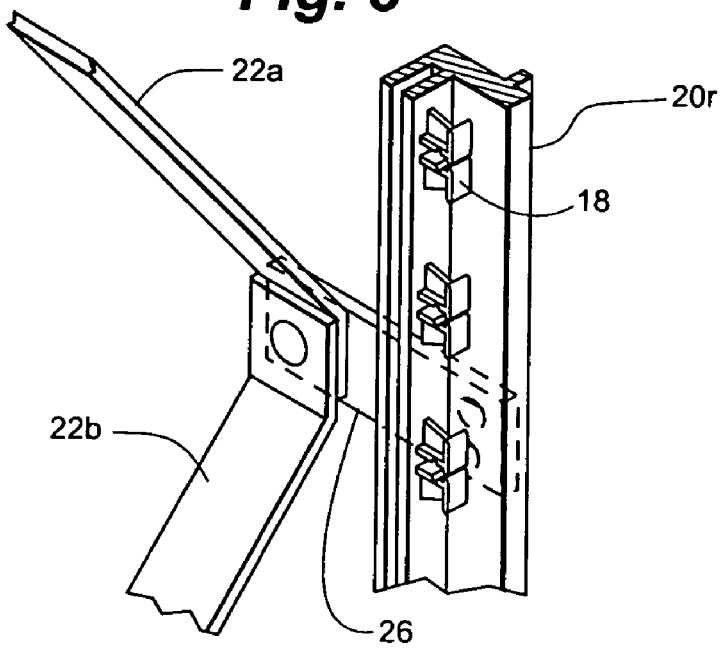
FIG. 3 depicts the connection between two cross members and a frame member.

Cross members 22 can connect to frame members, 20*l* and 20*r*, by any suitable structure or means. One such structure is shown in FIG. 3. FIG. 3 depicts a bracket or connecting member 26 attached to frame member 20*r*. Connecting members 26 preferably provide an offset between cross members 22 and display members 16, which is discussed below.

Figure 6:
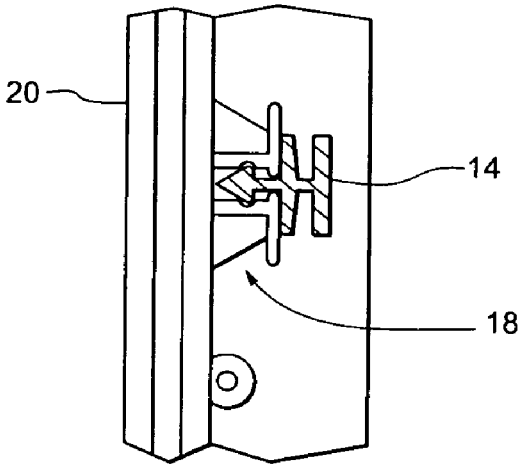
FIG. 6 is a sectional side elevation view of a display holder retained by a retention member.

Frame members 20*l* and 20*r* support a series of retention members 18. Retention members 18 may be formed as integral parts of frame members 20*l* and 20*r* by, e.g., molding, milling or machining, depending on the type of material of which frame members 20*l* and 20*r* are made. Alternately, retention members 18 may be separate parts or strips of parts which are directly secured to frame members 20*l* and 20*r*, for example, by welding or suitable fastener materials such as rivets, screws, adhesive, or by any other suitable material or means. Retention members 18 are preferably regularly spaced along the length of frame members, 20*l* and 20*r*. A spacing of approximately 3.8 cm is most preferred. Retention members 18 support display holders 14. Retention members 18 and display holders 14 may have any structure suitable for allowing retention members 18 to hold display holders 14. For example, retention members 18 could simply be screws. Preferably, however, retention members 18 and display holders 14 are designed so that display holders 14 can be removed and replaced without tools. Preferably, each display holder 14 is only engageable to retention member 18 in a direction perpendicular to a plane containing the two frame members so that display holders can be easily added and removed. For example, as shown in FIG. 6, retention members 18 can have a female portion into which a male portion of a display holder 14 can be inserted. Preferably retention members 18 on opposite vertical frame members 20 are arranged so the display holders 14 are held in a horizontal position.

Display holders 14 can have any suitable structure for holding translucent display members 16. Preferably display holders 14, frame members 20, cross members 22, and connecting members 26 are extruded aluminum, but any suitable rigid material can be used. Preferably each display holder 14 has top and bottom longitudinally extending channels. Most preferably, each display holder 14 has a front portion with an "H-shaped" cross-section and an integral rear male portion as shown in FIG. 6.

Display holders 14 may be spaced apart from one another as desired, for example, by approximately 3.8 cm to receive an approximately 3.8 cm inch display member 16, or alternatively display holders 14 may be spaced apart by 7.6 cm or more as desired to retain larger display members 16. Thus, it is further contemplated that all available retention members need not be used in order to incorporate larger display members in the display module.

Display members 16 are translucent or have portions which are translucent. The display members of the present invention may include indicia which provide food descriptions, pricing information, restaurant or company information, artwork, or any other desired information. Display members 16 are preferably elongated strips, as shown in FIG. 1, which have translucent portions such that light from light source 24 may project through the translucent portions of display member 16 such that the indicia on display members 16 are easily viewable, particularly in darkness. Preferably display members 16 are held in the channels of two adjacent display holders 14, i.e., with one display holder 14 below and another above. Typically, display members 16 are plastic so as to enable the display member to flex in order to be inserted within display holders 14; however, any other suitable material which has a translucent portion may be used. The capability for insertion is desirable because it allows display members to be replaced without having to disassemble other parts of the menu board.

Figure 4:
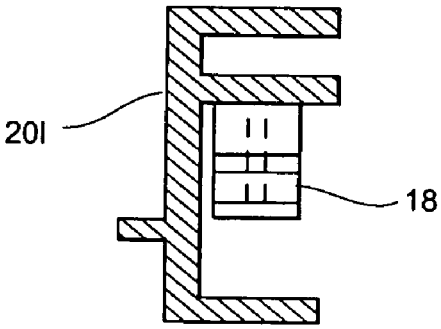
FIG. 4 is a sectional view of a frame member along line 4-4 of FIG. 1.
Figure 5:
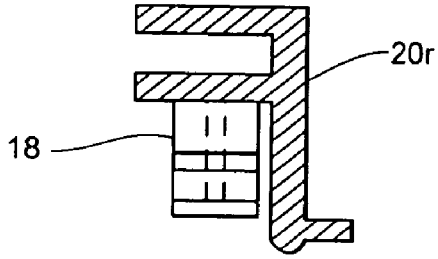
FIG. 5 is a sectional view of a frame member along line 5-5 of FIG. 1.

Display members 16 are preferably flexible because frame members 20*l* and 20*r* are designed to prevent display members from accidentally sliding out. Referring to FIGS. 4-6, frame member 20*l* surrounds a display member 16 on three sides, and frame member 20*r* surrounds a display member 16 on two sides, allowing a display member 16 to be slid into the channel of two adjacent display holders 14. However, frame member 20*r* extends forward of the display holders 14 to prevent display members 14 from accidentally sliding out.

As shown in FIG. 2, illuminated display device 12 includes menu board 10 and lighting source 24 for backlighting display members 16. Lighting source 24 preferably includes fluorescent light tubes, of a suitable length and wattage, but alternatively any other suitable lighting source can be utilized as is known in the art. Cross members 22 are located in between display members 16 and lighting source 24. Thus, cross members 22 could cast a shadow onto display members 16, which would undermine the legibility of display members 16 and could be distracting to people looking at the menu board.

To avoid casting shadows, cross members 22 could be located immediately behind and parallel to display holders 14. However this reduces the flexibility of arrangements of display holders 14 and display members 16. Preferably, cross members 22 are offset from display members 16 so that they do not cast a shadow. Anything that increases the likelihood of casting a shadow increases the necessary offset. Factors affecting the offset include the shape of cross members 22, the nature of light source 24, and how close the cross members 22 are to light source 24. In the preferred embodiments of the menu board, a distance between the front of cross member 22 and the front of display member 16 of about 5.4 cm has successfully prevented shadows from being cast. In the preferred embodiments, cross members 22 have a rectangular cross-section with a width of about 1.3 cm and a thickness of about 0.3 cm and light source 24 is two parallel fluorescent tubes located between about 0.8 to about 5.1 cm behind cross members 22. The width dimension of cross members 22 is perpendicular to a plane containing frame members 20*l* and 20*r*.

Illuminated display device 12 typically includes a housing (not shown) having at least one door secured to the housing via a hinge. The door has a suitable latching or locking mechanism (not shown) for securing the door in a closed position to protect the interior of illuminated display device 12. It is contemplated that any number of substantially transparent doors with viewing windows and latching or locking mechanisms may be utilized. The housing is preferably formed from any desirable relatively rigid and relatively weatherproof material, such as metal or plastic, and preferably aluminum, and which is suitable to protect the housing and door from the deleterious effects of sun, wind, rain, snow, freezing temperatures, and elevated temperatures, particularly when the display device is used in an outdoor environment. The door is also preferably of a weatherproof material and has a transparent portion so as to enable display modules to be viewed through the door. Thus, the transparent portion is preferably glass, but may be any other suitable transparent or substantially translucent material which is substantially weatherproof. The housing may be provided with suitable venting (not shown) for the interior.

It is contemplated that illuminated display device 12 may include as few or as many menu boards 10 as is desired. Thus, for example, one menu board may be for breakfast and a second menu board may be for lunch/dinner items.

While the invention has been described with respect to certain preferred embodiments, it is to be understood that the invention is capable of numerous changes, modifications, and rearrangements without departing from the scope or spirit of the invention as defined in the claims.

What is claimed is:

1. An illuminated display device comprising:

at least one display member having a translucent portion;

a frame comprising two substantially parallel frame members and at least one cross member, the frame members connected to the at least one cross member, the at least one cross member offset from and behind the at least one display member and behind a plane defined by the frame members, the at least one display member removably mounted to the frame; and a light source behind the display members whereby the display members are back lighted by the light source, wherein the at least one cross member is forward of the light source.

2. The device of claim 1 wherein the frame further comprises a second cross member connected to the frame members, the second cross member offset from and behind the at least one display member.

3. The device of claim 2 wherein the second cross member is disposed at an angle in the range of from about 60° to 90° to the first cross member.

4. The device of claim 2 wherein the second cross member does not intersect the first cross member.

5. The device of claim 4 further comprising a third cross member which does not intersect the first and second cross members.

6. The device of claim 1 wherein the at least one cross member connects to a first frame member near its end and connects to a second frame member near its middle.

7. The device of claim 1 wherein the at least one cross member is disposed substantially perpendicular to the frame members.

8. The menu board of claim 1 further comprising:

a plurality of connection members, the frame members connected to the at least one cross member by the connection members; and a plurality of retention members for holding display holders for holding the at least one display member, the retention members positioned on the frame members wherein the connection members project rearwardly from the frame members.

9. The menu board of claim 8 wherein the frame further comprises a second cross member connected to the frame members, the second cross member disposed at an angle less than 90 degrees to the frame members.

10. The menu board of claim 9 wherein the second cross member is disposed at an angle in the range of from about 60° to 90° to the first cross member.

11. The menu board of claim 8 wherein each of the frame members has a plurality of retention members and the display holders are supported by retention members on both frame members.

12. The device of claim 1 further comprising display holders having opposed longitudinally extending channels, wherein the display members are held in the channels of two adjacent display holders.

13. The device of claim 1 wherein the at least one cross member does not cast a shadow onto the at least one display member.

14. The device of claim 1 further comprising a plurality of bracket members, the bracket members projecting rearwardly from the frame members and connecting the at least one cross member to the parallel frame members.

15. A menu board comprising:

a frame comprising two substantially parallel frame members and first and second cross members connecting the frame members, the first cross member intersecting the second cross member, wherein the first and second cross members share a common portion;

a plurality of retention members for holding display holders for holding translucent display members, the retention members positioned on the frame members;

a plurality of display holders supported by the retention members, the display holders having top and bottom longitudinally extending channels; and a plurality of display members, the display members held in the channels of adjacent display holders, wherein the cross members are offset from the display members.

16. The menu board of claim 15 wherein the cross members are disposed at an angle in the range of from about 30° to about 60° to the frame members.

17. The menu board of claim 15 wherein the common portion is substantially vertical.

18. The menu board of claim 15 wherein the display holders have opposed longitudinally extending channels and the display members are held in the channels of two adjacent display holders.

19. The menu board of claim 15 wherein each of the frame members has a plurality of retention members and the display holders are supported by retention members on both frame members.

20. The menu board of claim 15 further comprising a light source behind the display members whereby the display members are back lighted by the light source.

21. The menu board of claim 20 wherein the first and second cross members are between the light source and the display members and are offset from the display members so that the first and second cross members do not cast a shadow on the display members.

22. A menu board comprising:

a non-rectangular frame consisting essentially of two substantially parallel frame members and at least one cross member, the frame members connected to the at least one cross member and the at least one cross member disposed at an angle less than 90 degrees to the frame members;

a plurality of retention members positioned on the frame members; and a plurality of display holders, the display holders having opposed longitudinally extending channels for holding a display member in the channels of adjacent display holders.

23. The menu board of claim 22 wherein the frame further comprises a middle member attached to the frame members near a midportion of the frame members.

24. The menu board of claim 22 wherein the at least one cross member is disposed at an angle in the range of from about 30° to about 60° to the frame members.

25. The menu board of claim 24 wherein the frame comprises a second cross member having a first portion disposed at an angle in the range of from about 30° to about 60° to a second frame member, a second vertical portion, and a third portion disposed at an angle in the range of from about 30° to about 60° to the second frame member.

26. The menu board of claim 22 wherein the parallel frame members are substantially vertical and the at least one cross member has a first portion disposed at an angle in the range of from about 30° to about 60° to a first frame member, a second vertical portion, and a third portion disposed at an angle in the range of from about 30° to about 60° to the first frame member.

27. The device of claim 22 further comprising a plurality of display members, the display members held in the channels.

28. The menu board of claim 27 further comprising a light source behind the display member whereby the display members are back lighted by the light source.

29. The menu board of claim 28 wherein the at least one cross member is between the light source and the display members and is offset from the display members so that the at least one cross member does not cast a shadow on the display members.

* * * * *